US006802337B2

(12) United States Patent
Phipps

(10) Patent No.: US 6,802,337 B2
(45) Date of Patent: Oct. 12, 2004

(54) VALVE CAN EXTENSION

(76) Inventor: Ronald C. Phipps, P.O. Box 293 417 Oaken Hills Dr., Willamina, OR (US) 97396

( * ) Notice: Subject to any disclaimer, the term of this patent is extended or adjusted under 35 U.S.C. 154(b) by 112 days.

(21) Appl. No.: 10/174,901

(22) Filed: Jun. 17, 2002

(65) Prior Publication Data

US 2003/0230343 A1 Dec. 18, 2003

(51) Int. Cl.[7] ..... F16L 5/00

(52) U.S. Cl. ..... 137/369; 137/367; 137/370; 137/371

(58) Field of Search ..... 137/369, 370, 137/371, 367

(56) References Cited

U.S. PATENT DOCUMENTS 1,486,707 A * 3/1924 Warner ..... 137/369
2,931,383 A * 4/1960 Handley ..... 137/369
4,064,902 A * 12/1977 Swenson ..... 137/370
5,220,942 A * 6/1993 Garvin, Jr. et al. ..... 137/556
5,803,125 A * 9/1998 Bliss ..... 137/370

* cited by examiner

*Primary Examiner*—A. Michael Chambers
(74) *Attorney, Agent, or Firm*—Schwabe, Williamson & Wyatt, P.C.

(57) ABSTRACT

Apparatus and methods are provided for the extension of access conduits to access underground valves and the like. A valve can extension comprising a tubular member having an extension riser portion at one end and an inwardly tapered portion at the other end. The extension riser portion has a substantially constant inner and outer diameter defining a substantially uniform wall thickness. The inwardly tapered portion is adapted to be inserted into and frictionally engage a valve can bell housing. The valve can extension and valve can bell housing assembly form a conduit from grade level to the bell portion having a substantially uniform inner and outer diameter. A simple friction fit joining method is provided to negate the need for complex mechanical coupling devices. The valve can extension further provides the ability to change the elevation of the valve can without the necessity of major excavation and back-filling to gain access to and rebury the coupling between the valve can extension and the bell housing.

12 Claims, 4 Drawing Sheets

VALVE CAN EXTENSION

FIELD OF THE INVENTION

This invention relates to underground access conduit for accessing an underground valve or other underground mechanism from an aboveground position, and more particularly, to the adaptation or extension of the access conduit to grade level.

BACKGROUND OF INVENTION

Municipal utility companies usually supply their services, such as gas and water, to their customers via underground pipes. Flow control valves are placed along the pipes to control the supply to individual customers. It is not uncommon that the control valves that supply individual customers be located under ground at the curb of an adjacent roadway.

For example, in a municipal water system, the source of water is the water main that runs beneath the street. A valve, referred to as a curb stop, is located at the property line between the main and the customer inlet water pipe to control the flow of water to the customer. The curb stop is used to shut off the water for repairs, nonpayment of water bills, flooded basements, and the like. The curb stop is used as the isolation valve. The curb stop is accessed from aboveground through a conduit known by many names, such as valve can, valve box, or curb box, that extends from the valve to ground level, providing a conduit for inserting a long-handled wrench or "key" used to reach the valve.

FIGS. 1–2 illustrate a common type of curb box 2 currently in use. The curb box 2 comprises a generally tubular casing 10 having an enlarged lower bell housing 12 that is adapted to cover at least a portion of the valve 6 containing the control knob 4. The upper end of the curb box 2 generally includes a cover 30 which is commonly flush with grade level 8. The cover 30 is coupled to the casing 10 via a box top 20 which is used to reinforce the surface end 14 of the casing 10. The box top 20 provides a lower end 22 adapted such that the surface end 14 is slidably received into the lower end 22. The box top 20 provides an upper end 24 adapted to couple with the cover 30.

Typically, an elongated wrench is used to reach down into the curb box 2 to turn the valve operating knob 4, which is often referred to as a valve head. The location of the valve 6 below grade can vary depending on many considerations, including the freeze level and the mains depth. For example, the depth of the mains can be between 1 to 4 meters (3–12 ft.) below grade level 8.

The curb box 2 is initially installed in the same open trench prepared for the pipes and associated valve 6. The curb box 2 is placed over the valve 6 and held perpendicular to grade level. The trench is back-filled surrounding the curb box 2 with backfill material. During the back-filling procedure, the curb box 2 is properly located with respect to the valve 6 and, even though the back-filling may be performed using bulldozers, back hoes or other power equipment, the curb box 2 must stay positioned on the valve 6 even though subjected to lateral forces and pressures while being surrounded by backfill material.

During initial installation of the curb box 2, and prior to back-filling the trench, there are number of methods used to establish the proper length of the curb box 2 such that it is flush with grade level 8 while properly containing the valve 6. One method is to cut the casing 10 at the surface end 14 to the proper length. This method is relatively straight-forward for installations wherein the casing 10 is relatively short in length and that the cutting is made prior to placement over the valve 6. It does require some skill in making the correct cut in length on the first attempt.

For installations requiring the casing 10 to be longer, it is not uncommon that the casing 10 be comprised of two or more sections: a lower bell section 10*a* and one or more upper extension sections 10*b* which are coupled together using mechanical coupling devices 11, such as with a band clamp and the like, as shown in FIG. 3. The bell section 10*a* includes the bell housing 12 at a lower end 16 and a tubular portion 13 at an upper end 15. The one or more upper extension sections 10*b* comprise a tubular member having a predetermined length and having a uniform diameter of the same size as the diameter of the upper end 13. One end of the upper extension section 10*b* is coupled to either another upper extension section 10*b* or the upper end 13 of the bell section 10*a*.

The adjacent ends of any two sections 10*a*, 10*b* are commonly butt joined and held together with any number of coupling devices 11, such as a screw-driven band clamp, or a bolted or threaded union coupling. Assembly of the sections either outside of the trench or within the trench is relatively straight-forward but time consuming. The mechanical coupling devices 11 require proper assembly to hold and retain the joining sections 10*a*, 10*b* in coaxial alignment, a time consuming process requiring centering, alignment, shifting and adjustments.

It is not uncommon that during the service life of the curb stop 6, there is a need for the curb box 10 to accommodate for elevation change of grade level 8, either upwards or downwards. This might be due, for example, to the addition of pavement in a street installation or to a change in landscaping.

For example, during roadway resurfacing, a layer of paving material is caused to become disposed over the existing pavement, resulting in the curb box cover 30 being below the grade level 8 of the new pavement and thereby causing a depression in the roadway. It becomes necessary to either replace the existing curb box 10 with one of the proper length or disassemble a multi-section curb box 2 and reinstall a longer upper extension section 10*b*.

The method to replace or disassemble the curb box 2 is usually to excavate the area above the casing 10, provide some method of retention of the unexcavated material, and have repair personnel enter the excavation to facilitate the replacement or reassembly of the casing 10 with one of proper length. The process of excavation to gain access to the curb box 2 or the coupling device 11 involves the use of heavy excavation equipment risking damage to the curb box 2. Further, the coupling device 11 might be inoperable due to corrosion making removal difficult.

Apparatus and methods for the adjustment of the height of the curb box 2 that is completed from above grade level with a minimum of excavation would be advantageous in terms of time, labor and equipment costs while minimizing the potential for damage to the curb box 2.

SUMMARY OF INVENTION

The present invention comprises a valve can extension for use as a component of a valve can, otherwise known as a curb box or valve box. The valve can is used between an underground valve and the ground surface providing a conduit such that the valve handle may be turned from aboveground using an elongated key. The valve can extension comprises a tubular column having an extension riser portion at one end and an inwardly tapered portion at the other end. The extension riser portion has a substantially constant inner and outer diameter defining a substantially uniform wall thickness. The inwardly tapered portion is adapted to be inserted into and frictionally engage a valve can bell housing forming a valve can having a substantially uniform inner and outer diameter from above the bell portion of the bell housing to grade level. The valve can extension provides the ability to establish the elevation of the valve can with regards to grade level. A simple joining method is provided to negate the need for complex mechanical coupling devices. The valve can extension further provides the ability to change the elevation of the valve can without the necessity of major excavation and back-filling to gain access to and rebury the coupling between the valve can extension and the bell housing.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

The following embodiments and figures refer to a curb box. A curb box is just one example of a valve can; that is, an access conduit between an underground valve and the surface to access the valve head from aboveground. The invention can be incorporated in many valve can embodiments, and the present invention is not limited to any particular valve can described. The valve upon which the valve can is positioned can include any type of valve suitable for aboveground access, such as gas valves, water valves, and other flow-control devices. The invention is not limited to valve cans, per se, but can also be used in other applications wherein above ground access is required to below ground devices. Such devices include, but are not limited to, electrical switches and reset breakers, and the like.

The present invention comprises a curb box extension for use as a component of a curb box. The curb box extension provides the ability during initial installation of the curb box to establish the elevation of the curb box with regards to grade level. Access by personnel at trench level is not necessarily required. A simple joining method is provided to negate the need for complex mechanical coupling devices. The curb box extension further provides the ability to change the elevation of the curb box without the necessity of major excavation and back-filling to gain access to and rebury the coupling between the curb box extension and the riser of the curb box casing.

Figure 4:
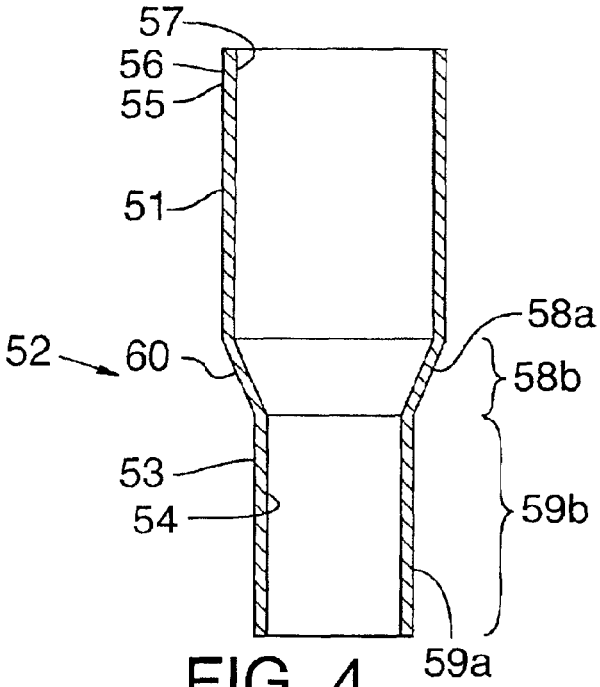
FIG. 4 is a side cross-sectional view of a curb box extension in accordance with an embodiment of the invention.

FIG. 4 illustrates a side view of a curb box extension 50 in accordance with an embodiment of the invention. The curb box extension 50 comprises a tubular column having an extension riser portion 51 and a tapered portion 52. The extension riser portion 51 has a substantially constant riser outer diameter 56 and riser inner diameter 57 defining a substantially constant wall thickness. The extension riser portion 51 extends from the tapered portion 52 terminating at a top end 55.

The tapered portion 52 comprises a tapered section 58*a* and a straight section 59*a*. The tapered section 58*a* extends from the riser portion 51 to the straight section 59*a*. The tapered section 58*a* tapers inwardly and has a predetermined taper length 58*b*. The tapered section 58*a* extends to the straight section 59*a*. The straight section 59*a* has a predetermined straight length 59*b* having a substantially constant straight-section outer diameter 53 and straight-section inner diameter 54 defining a substantially constant wall thickness.

Figure 1:
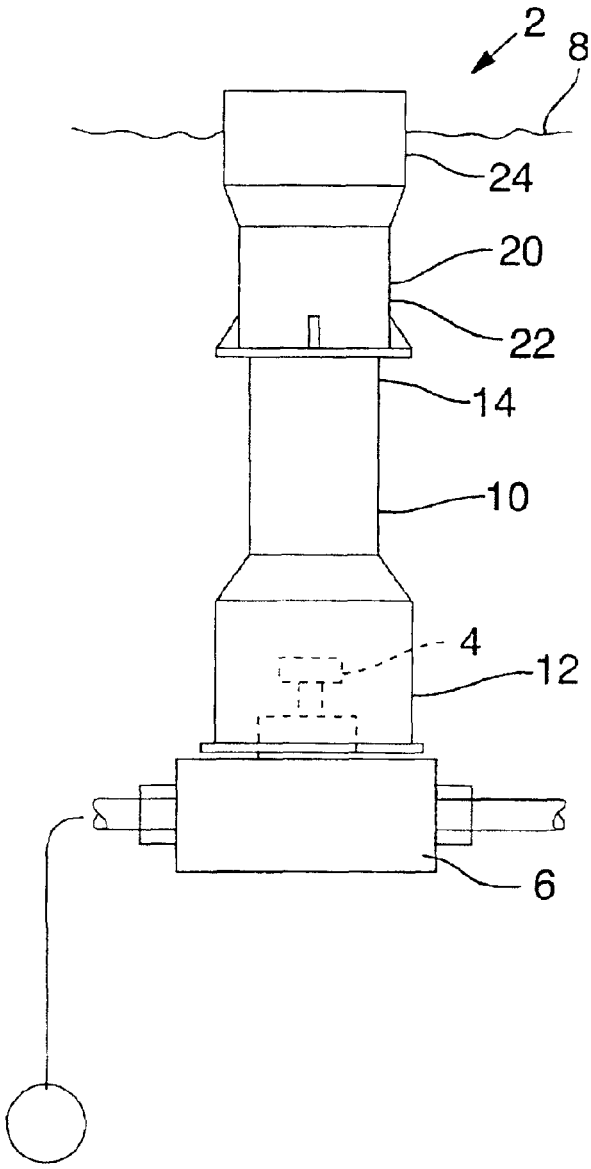
FIG. 1 (Prior Art)
FIGS. 1–2 illustrate a common type of curb box known in the art.
Figure 2:
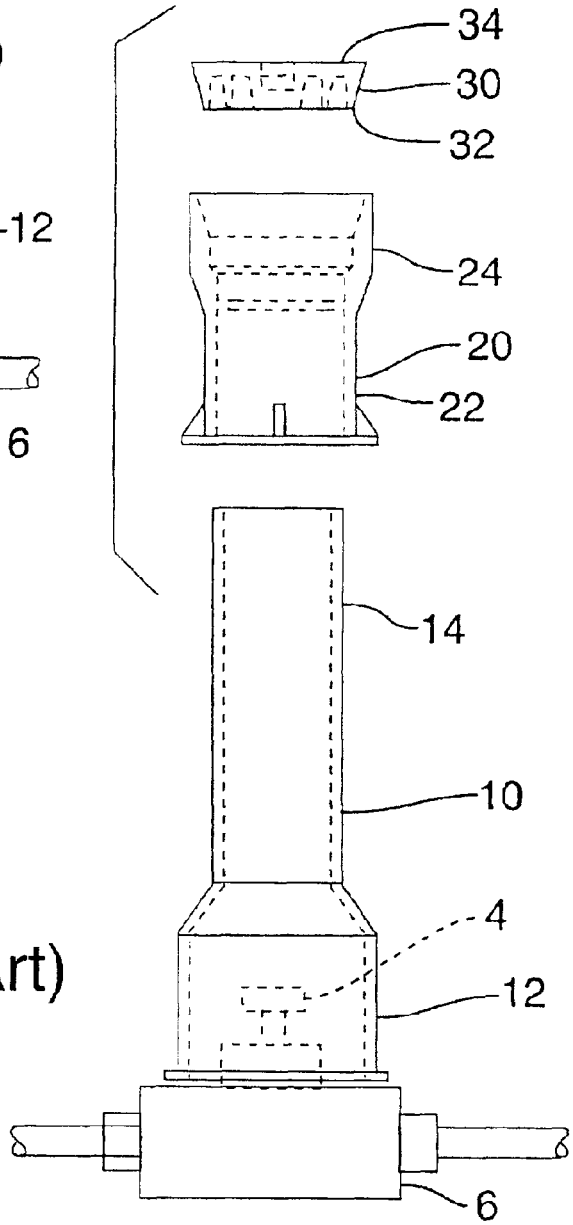
FIG. 2 (Prior Art)
Figure 3:
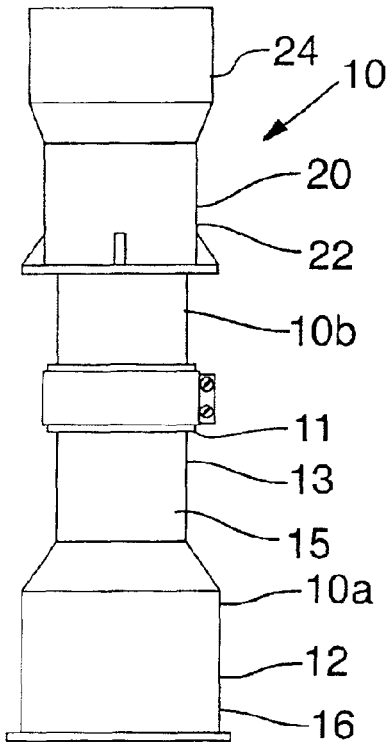
FIG. 3 (Prior Art)
FIG. 3 is a side view of a segmented curb box coupled using a coupling device known in the art.
Figure 5:
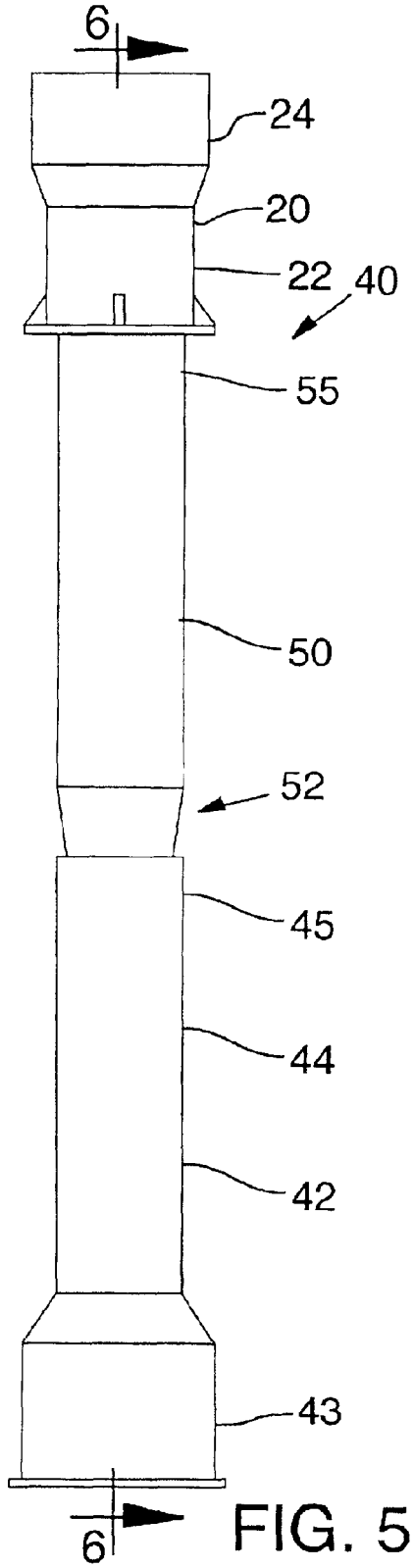
FIG. 5 is a side view of a curb box comprising a curb box extension in accordance with an embodiment of the invention.
Figure 6:
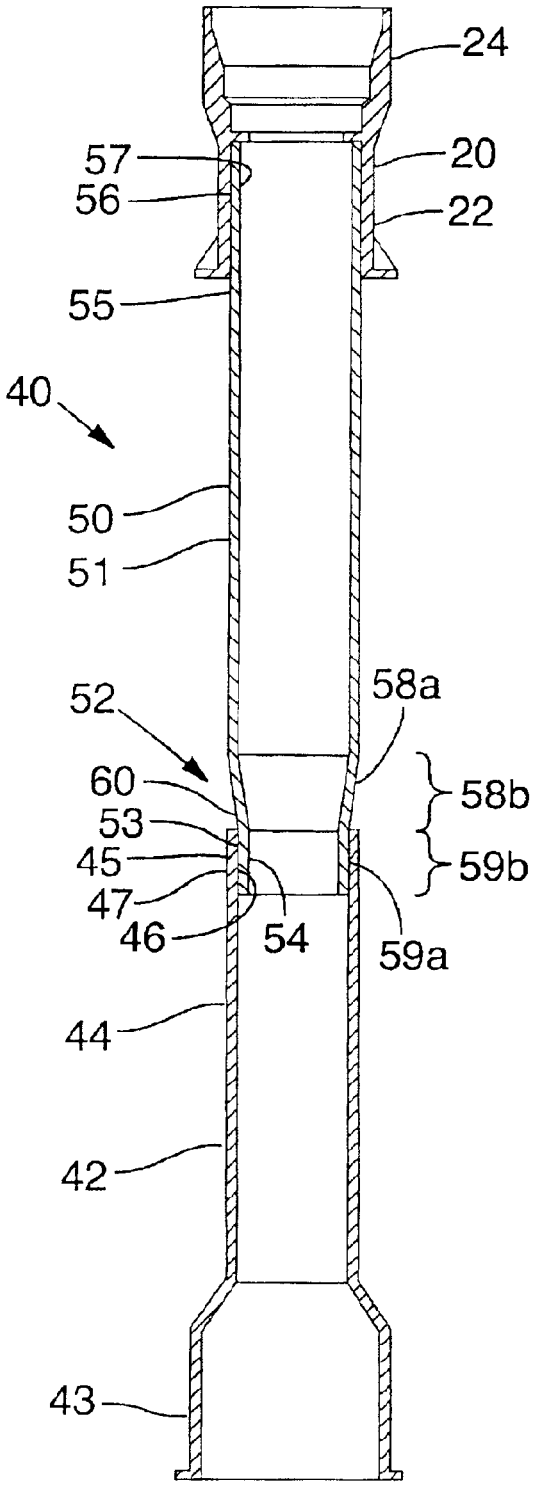
FIG. 6 is a side cross-sectional view of a curb box comprising a curb box extension in accordance with an embodiment of the invention.

FIGS. 5 and 6 illustrates a side view and cross-sectional view along cut-line 6—6, respectively, of the curb box extension 50 as assembled as part of a curb box 40, in accordance with an embodiment of the invention. A curb box casing 42 comprises a bell housing end 43 and a casing riser 44. The bell housing end 43 is adapted to cover or enclose a valve head 4 as discussed earlier and shown in FIG. 2. The bell housing end 43 has a diameter and a length adapted for a particular valve; the bell housing diameter being greater than, equal to, or less than the diameter of the casing riser 44, as required.

The casing riser 44 comprises a tubular column of substantially constant casing-riser inner diameter 46 and casing-riser outer diameter 47 extending from the bell housing end 43 to a riser top 45. The casing-riser inner diameter 46 and casing-riser outer diameter 47 defines a casing-riser wall thickness. The length of the casing riser 44 is adapted for a particular purpose. The length of the casing riser 44 may be adapted to extend to grade level, or to extend somewhat short of grade level in anticipation of using one or more curb box extensions 50.

Figure 7:
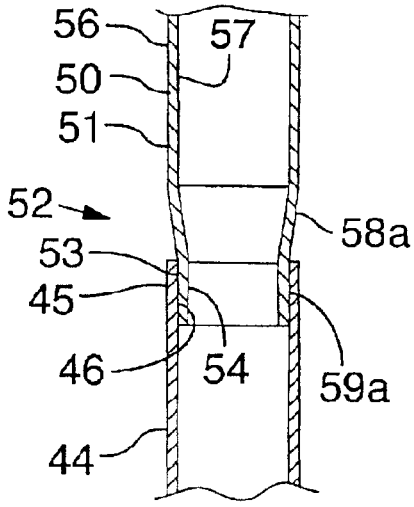
FIG. 7 is a side view of a curb box extension in accordance with an embodiment of the invention.

The tapered portion 52 is adapted to be slidably received into the casing riser 44 at the riser top 45. In one embodiment in accordance with the invention, as shown in FIG. 7, the straight-section outer diameter 53 is substantially the same as the casing-riser inner diameter 46 such that the straight section 59*a* of the tapered portion 52 engages the casing riser 44 about the riser top 45 in friction engagement. The straight-section inner diameter 54 of the tapered portion 52 is smaller than the casing-riser inner diameter 46 by a dimension equal to or slightly greater than twice the wall thickness of the casing riser 44. The straight-section inner diameter 54 of the tapered section 58*a* is adapted to be sufficiently large to accept a valve head turning tool there through.

Figure 8:
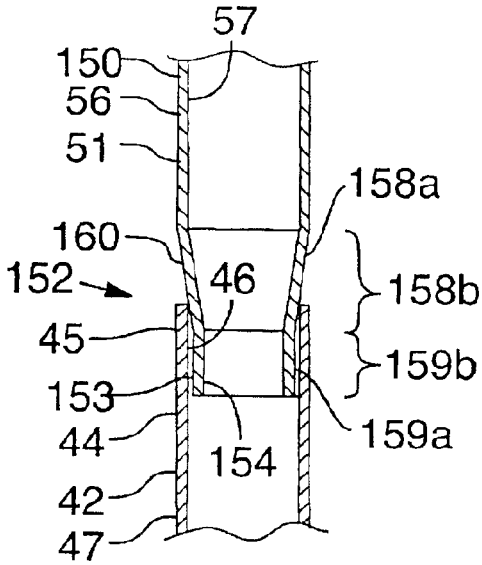
FIG. 8 is a side view of a curb box extension in accordance with another embodiment of the invention.

In another embodiment in accordance with the invention, as shown In FIG. 8, the straight-section outer diameter 153 is slightly smaller as the casing-riser inner diameter 46 such that the straight section 159*a* can freely enter the, riser top 45 such that the tapered section 158*a* of the tapered portion 152 engages the riser top 45 in friction engagement. The straight-section inner diameter 154 of the tapered section 158*a* is adapted to be sufficiently large to accept a valve head turning tool there through.

The casing-riser outer diameter 47 is substantially the same as the extension riser outer diameter 56 of the extension riser portion 51. This provides a substantially constant outer surface of the curb box 40 along the length from above the bell housing end 43 and the top end 45. The casing-riser inner diameter 46 is also substantially the same as the extension riser inner diameter 57 of the extension riser portion 51.

The straight length 159*b* is adapted to be sufficiently long to provide stability to the curb box extension 150 when coupled to the curb box casing 42. The straight length 159*b* dimension will depend on many factors, including, but not limited to, the weight of the curb box extension 150 box top 20 and cover, the extension riser outer diameter 56, and the material from which the curb box extension is made. It has been found for a curb box extension made from PVC (polyvinyl chloride) having a length of 122 cm (4 ft.), a riser outer diameter 56 of 15.24 cm (6 inches) with a wall thickness of 0.635 cm (0.25 inches), a straight length 59*b* dimension of 7.62 cm (3 inches) provides satisfactory stability and coupling.

The tapered section 58*a* tapers inwardly and has a predetermined taper length 158*b*. A relatively long taper length 158*b* provides a larger surface contact area, and therefore, greater friction engagement between the surface defined by the casing-riser inner diameter 46 and the taper outer surface 160, as shown in FIG. 8. Therefore, a relatively long taper length 158*b* provides proper coupling between the curb box casing 42 and the curb box extension 150 for applications wherein only frictional engagement is the primary coupling mechanism between the tapered section 158*a* and the taper outer surface 160.

Figure 9:
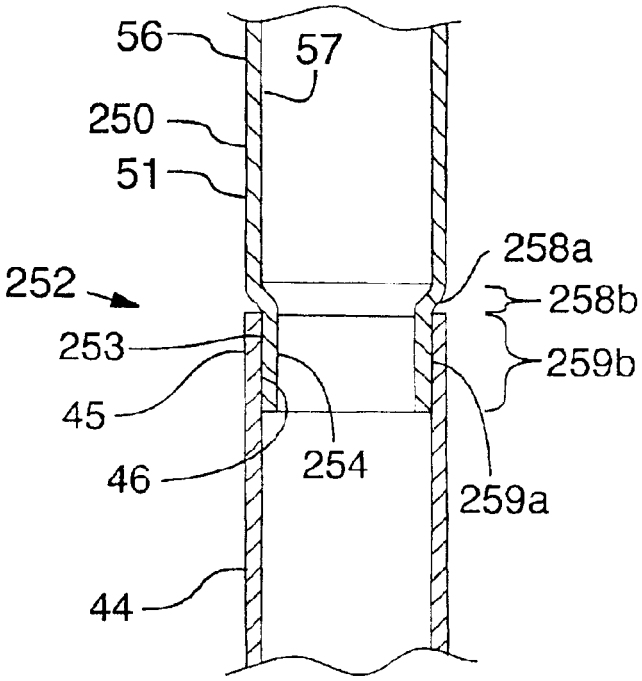
FIG. 9 is a side view of a curb box extension in accordance with another embodiment of the invention.

The curb box extension 250 as shown in FIG. 9, in accordance with another embodiment of the invention, has a relatively short taper length 258*b* and a casing-riser Inner diameter 46 that is substantially the same as the surface defined by the straight-section outer diameter 253. This embodiment provides a larger surface area having a uniform outer diameter, and therefore, greater friction engagement between the surface defined by the casing-riser inner diameter 46 and the surface defined by the straight-section outer diameter 253. Therefore, a relatively short taper length 258*b*, up to and including a taper in the form of a step, primarily relies on the frictional engagement between the curb box casing 42 and the curb box extension 250 for frictional engagement between the straight section 259*a* and the surface defined by the casing-riser inner diameter 46.

Figure 10:
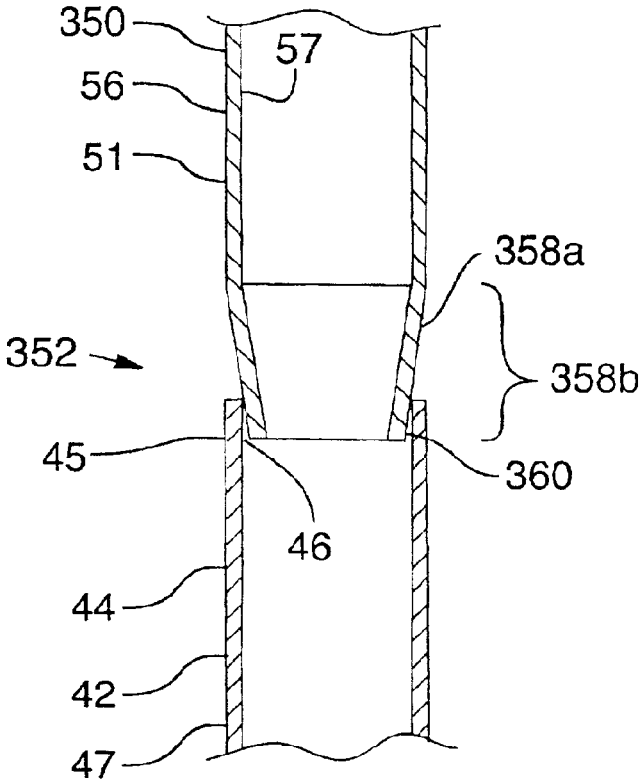
FIG. 10 is a side view of a curb box extension in accordance with another embodiment of the invention.

The curb box extension 350 as shown in FIG. 10, in accordance with another embodiment of the invention, has a relatively long taper length 358*b* with no straight section. The tapered section 358*a* tapers inwardly and has a predetermined taper length 358*b*. A relatively long taper length 358*b* provides a larger surface contact area, and therefore, greater friction engagement between the surface defined by the casing-riser inner diameter 46 and the taper outer surface 360. Therefore, a relatively long taper length 358*b* provides proper coupling between the curb box casing 42 and the curb box extension 350 for applications wherein the coupling is produced with frictional engagement between the tapered section 358*a* and the taper outer surface 360.

The curb box casing 42 and the curb box extension 50 can be made from any suitable material adapted to withstand the effects of being in contact with ground or backfill material. In one embodiment, the curb box casing 42 and the curb box extension 50 is made of suitable rigid plastic such as, but not limited to, PVC or ABS (acrylonitrile butadiene styrene). In the case of the use of plastic materials, the coupling between the curb box casing 42 and the curb box extension 50 can be augmented with suitable plastic adhesive. Such a use of adhesive would preclude the removal of the curb box extension 50 at a later date for replacement, but may be preferable for certain permanent installations.

The two primary methods of installation of the curb box extension 50 is during initial installation of the valve and curb box 40, and to repair/extend established installations.

During initial installation of the valve and curb box 40, a trench is provided wherein the curb box 40 is placed over the valve head 4. The trench is back-filled with backfill or earth to engage the outer surfaces of the curb box casing 42 and the curb box extension 50. The inward force imposed upon outer surfaces will insure that the frictional engagement between the curb box casing 42 and the curb box extension 50 will remain stable over time.

In established installations comprising a curb box 40 having a curb box extension 50, the repair/replacement/extension of the curb box 40 requires little excavation and disturbance of the curb box 40. The box top 20 is lifted off of the top end 55 of the curb box extension 50 by minimally excavating the area adjacent to the box top 20. This excavation is relatively minor and does not require heavy machinery; just hand tools. It is possible, depending on soil conditions, that the existing curb box extension 50 can simply be rotated to loosen and release the frictional engagement between the curb box 40 having a curb box extension 50. The soil may be compacted sufficiently to enable the existing curb box extension 50 to be removed from the ground with little or no soil falling in the unsupported bore.

A new curb box extension 50 is cut to the required length and inserted into the bore now formed in the soil above the valve. The tapered portion 52 is simply inserted into riser top 45 of the curb box casing 42. The box top 20 is replaced over the top end 55 of the extension riser.

This method involves very little excavation as a larger opening is not required to gain access to remove, replace and secure a coupling 11. The process is relatively quick as the extension riser is simple inserted with a friction fit. The installation is also less expensive in both labor savings and material costs, as a coupling 11 is not required.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A curb box extension for coupling to a tubular curb box bell housing having a bell end and a riser end, comprising:

an elongated tubular member of predetermined length having a riser portion at a first end and a tapered portion at a second end opposite the first end, the tapered portion being adapted to be slidably received into the riser end and in frictional engagement therewith, the riser portion having an inner and outer diameter substantially the same as the riser end.

2. The curb box extension of claim 1, the tapered portion comprising an inwardly tapered section adjacent the riser portion, and a straight section adjacent the tapered section and opposite to the riser portion, the straight section having a substantially uniform straight section inner diameter and straight section outer diameter, the riser end further comprising a riser end inner diameter, the straight section outer diameter being substantially the same as the riser end inner diameter, the straight section being adapted to be slidably received into the riser end and in friction engagement therewith.

3. The curb box extension of claim 1, the tapered portion comprising an inwardly tapered section adjacent the riser portion, and a straight section adjacent the tapered section and opposite to the riser portion, the riser end further comprising a riser end inner diameter, the straight section having an outer diameter smaller than the riser end inner diameter, the straight section being adapted to be slidably received into the riser end, at least a portion of the tapered section being adapted to be slidably received into the riser end and in frictional engagement therewith, the riser portion having an inner and outer diameter substantially the same as the riser end.

4. The curb box extension of claim 1, the tapered portion comprising an inwardly tapered section adjacent the riser portion, and a straight section adjacent the tapered section and opposite to the riser portion, the straight section having a substantially uniform straight section inner diameter and straight section outer diameter, the riser end further comprising a riser end inner diameter, the straight section outer diameter being substantially the same as the riser end inner diameter, the straight section being adapted to be slidably received into the riser end and in frictional engagement therewith, at least a portion of the tapered section being adapted to be slidably received into the riser end and in frictional engagement therewith, the riser portion having an inner and outer diameter substantially the same as the riser end.

5. A curb box for covering a control lever, comprising:

a first elongated tubular member of predetermined length having a bell portion and a first riser portion, the first riser portion having a first riser inner diameter and a first riser outer diameter, the bell portion having a bell inner diameter and a bell outer diameter, the bell inner diameter adapted to at least partially accept and cover the control lever; and a second elongated tubular member of predetermined length having a second riser portion and a tapered portion, the tapered portion being adapted to be slidably received into the first riser portion and in frictional engagement therewith; the first riser portion having an inner and outer diameter substantially the same as the second riser portion.

6. The curb box of claim 5, the tapered portion comprising an inwardly tapered section adjacent the second riser portion, and a straight section adjacent the tapered section and opposite to the second riser portion, the straight section having a substantially uniform straight section inner diameter and straight section outer diameter, the straight section outer diameter being substantially the same as the first riser inner diameter, the straight section being adapted to be slidably received into the first riser portion and in frictional engagement therewith.

7. The curb box of claim 5, the tapered portion comprising an inwardly tapered section adjacent the second riser portion, and a straight section adjacent the tapered section and opposite to the second riser portion, the straight section having an outer diameter smaller than the first riser inner diameter, the straight section being adapted to be slidably received into the first riser portion, at least a portion of the tapered section being adapted to be slidably received into the first riser portion and in frictional engagement therewith, the first riser portion having an inner and outer diameter substantially the same as the second riser portion.

8. The curb box of claim 5, the tapered portion comprising an inwardly tapered section adjacent the second riser portion, and a straight section adjacent the tapered section and opposite to the second riser portion, the straight section having a substantially uniform straight section inner diameter and straight section outer diameter, the straight section outer diameter being substantially the same as the first riser inner diameter, the straight section being adapted to be slidably received into the second riser portion and in frictional engagement therewith, at least a portion of the tapered section being adapted to be slidably received into the second riser portion and in frictional engagement therewith, the second riser portion having an inner and outer diameter substantially the same as the first riser portion.

9. A valve can assembly comprising:

a lower valve can section including a valve can housing adapted to protectively surround an underground valve and a tubular portion extended above said housing and providing accessibility to said underground valve, said tubular portion having an upper end defining an interior configuration;

a tubular extension for coupling to said upper end of said tubular portion, said tubular extension having a lower end portion defining an exterior configuration, said exterior configuration of said tubular exterior and said interior configuration of said upper end of said tubular portion mated to permit slidable insertion of said lower end portion inside said upper end and said exterior and interior configurations further mated to limit said slidable insertion of said tubular extension into said upper end whereby said tubular extension extends upwardly from said valve can housing to a determined position above said underground valve to provide accessibility to said valve through said tubular portion and exterior.

10. A valve can assembly as defined in claim 9 wherein the tubular portion defines an exterior cylindrical wail and said tubular extension defines an exterior cylindrical wall similar to that of said tubular portion.

11. A valve can assembly as defined in claim 10 wherein said lower end portion of said tubular extension is inset from the exterior cylindrical wall thereof and defines a shoulder that limits insertion of said tubular extension into said tubular portion.

12. A valve can assembly as defined in claim 11 wherein said upper end of said tubular portion has an inner cylindrical dimension and said exterior configuration of said lower end of the extension has a similar and mated cylindrical dimension for close fit seating of said extension into the upper end of said tubular portion.

* * * * *

UNITED STATES PATENT AND TRADEMARK OFFICE

CERTIFICATE OF CORRECTION

PATENT NO. : 6,802,337 B2
DATED : October 12, 2004
INVENTOR(S) : Phipps

It is certified that error appears in the above-identified patent and that said Letters Patent is hereby corrected as shown below:

Column 8,
Line 50, “cylindrical wail” should read -- cylindrical wall --.

Signed and Sealed this

Fifth Day of April, 2005

JON W. DUDAS
*Director of the United States Patent and Trademark Office*